US007037390B2

(12) United States Patent
Miyahara et al.

(10) Patent No.: US 7,037,390 B2
(45) Date of Patent: May 2, 2006

(54) METHOD OF HEAT TREATMENT FOR NI-BASE ALLOY TUBE

(75) Inventors: Osamu Miyahara, Amagasaki (JP); Toshihiro Imoto, Kobe (JP); Hiroyuki Anada, Nishinomiya (JP); Kazuyuki Kitamura, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 376 days.

(21) Appl. No.: 10/681,117

(22) Filed: Oct. 9, 2003

(65) Prior Publication Data

US 2004/0103963 A1 Jun. 3, 2004

Related U.S. Application Data

(63) Continuation of application No. PCT/JP03/01451, filed on Feb. 12, 2003.

(30) Foreign Application Priority Data

Feb. 13, 2002 (JP) ..... 2002-035878

(51) Int. Cl.
*C22C 1/10* (2006.01)

(52) U.S. Cl. ..... 148/677; 148/675; 148/426; 148/427; 428/472; 428/472.1

(58) Field of Classification Search ..... None
See application file for complete search history.

(56) References Cited

U.S. PATENT DOCUMENTS 5,413,642 A * 5/1995 Alger ..... 148/239
6,482,528 B1 11/2002 Anada et al.
6,488,783 B1 * 12/2002 King et al. ..... 148/280

FOREIGN PATENT DOCUMENTS

| | | |
|---|---|---|
| FR | 2 267 379 | 12/1975 |
| JP | 50-133910 | 10/1975 |
| JP | 53-6212 | 1/1978 |
| JP | 54-48619 | 4/1979 |
| JP | 64-55366 | 3/1989 |
| JP | 1-159362 | 6/1989 |
| JP | 2-47249 | 2/1990 |
| JP | 2-80552 | 3/1990 |

(Continued)

*Primary Examiner*—John P. Sheehan
(74) *Attorney, Agent, or Firm*—Buchanan Ingersoll PC

(57) ABSTRACT

A method of heat treatment for an efficient forming of two-layered oxide film on the inside surface of a Ni-base alloy tube. The oxide film suppresses the Ni release in a high-temperature water environment.

At least two gas supplying devices are provided on the outlet side of a continuous heat treatment furnace; or one gas supplying device is provided respectively on the outlet side and the inlet side thereof. The tube is put into the furnace while supplying an atmospheric gas into the tube from the front end of the tube moving direction with one of these gas supplying devices and a gas introducing pipe, which is arranged inside the furnace, and this tube is maintained at 650 to 1200° C. for 1 to 1200 minutes. The atmospheric gas consists of hydrogen or a mixture of hydrogen and argon, whose dew point is in a range of from −60° C. to +20° C. After the front end of the Ni-base alloy tube reaches the outlet side of the furnace, the supply of atmospheric gas into the tube is switched to the supply from other gas supplying device. The operations are repeated.

20 Claims, 4 Drawing Sheets

FOREIGN PATENT DOCUMENTS

| | | |
|---|---|---|
| JP | 3-153858 | 7/1991 |
| JP | 4-350180 | 12/1992 |
| JP | 11-21629 | 1/1999 |
| JP | 11-256308 | 9/1999 |
| JP | 2002-121630 | 4/2002 |
| JP | 2002-228361 | 8/2002 |
| WO | WO 02/14566 A1 | 2/2002 |

* cited by examiner

METHOD OF HEAT TREATMENT FOR NI-BASE ALLOY TUBE

This application is a continuation of International Application No. PCT/JP03/01451 filed on Feb. 12, 2003, and claims priority under 35 U.S.C. §§119 and/or 365 to 2002-035878 filed in Japan on Feb. 13, 2002, the entire content of which is hereby incorporated by reference.

TECHINICAL FIELD

The present invention relates to a method of heat treatment for a Ni-base alloy tube. The method makes it possible to produce a Ni-base alloy tube having an oxide film on the inside surface of the tube at a low cost in mass-production. The oxide film can suppress the Ni release from the material of the tube.

BACKGROUND

Since Ni-base alloys are excellent in corrosion resistance and mechanical properties, they have been used for the material of various members. In particular, the Ni-base alloys has been used for atomic reactors, since when it is exposed to high temperature water, it has excellent corrosion resistance. For example, as a heat exchanger tube for a steam generator in the pressurized water reactor (PWR), alloy 690 (trade name), i.e., 60% Ni—30% Cr—10% Fe, is used.

These members are used in high temperature water of about 300° C., which is the environment of the reactor water, for several years for shorter life and for tens years for longer life. Although the Ni-base alloy is excellent in corrosion resistance and has a small corrosion rate, some amount of Ni may be released from the alloy as Ni ions during a long period of time.

The released Ni is carried to the core of the reactor in the circulating process of the reactor water and is irradiated with neutrons in the vicinity of nuclear fuel. When Ni is subjected to the neutron irradiation, it is converted to Co by a nuclear reaction. Since Co has a very long half-life, it continues to emit radiation for a long period of time. Therefore, when the amount of released Ni is large, the dosage of radiation to workers, who carry out periodical inspections and the like, increases.

It is very important to reduce the dosage of radiation when using the light water reactor for a long period of time. Therefore, some measures to prevent the Ni release from the Ni-base alloy, such as an improvement of corrosion resistance of the alloy and controlling the water quality in the atomic reactor have been adopted.

The Japanese laid-open patent publication Sho.64-55366 discloses a method of improving general corrosion resistance by annealing a heat exchanger tube of Ni-base alloy in an atmosphere of a vacuum degree of $10^{-2}$ to $10^{-4}$ torr, at a temperature range of 400 to 750° C., in order to form an oxide film mainly consisting of chromium oxide. Further, the Japanese laid-open patent publication Hei.1-159362 discloses a method of improving intergranular stress corrosion cracking resistance. In the method, oxygen of $10^{-2}$ to $10^{-4}$ volume % is introduced into an inactive gas for heat treatment, and the alloy is heat-treated at a temperature range of 400 to 750° C. to produce an oxide film consisting mainly of chromium oxide ($Cr_2O_3$).

The Japanese laid-open patent publications Hei.2-47249 and Hei.2-80552 disclose methods of suppressing the dissolution of Ni and Co in the stainless steel for a super-heater tube by heating it in an inert gas containing a specified amount of oxygen, in order to form a chromium oxide film.

The Japanese laid-open patent publications Hei.3-153858 discloses a dissolution resistant stainless steel in high temperature water. The stainless steel is provided with an oxide layer, which contains more amounts of Cr-containing oxide than oxide that does not contain Cr, on its surface.

All of these methods reduce the amount of released metals by forming an oxide film consisting mainly of $Cr_2O_3$ by heat treatment. However, the $Cr_2O_3$ films obtained by the methods lose the release preventing effect by damaging the film over a long period of time. The reasons are considered to be insufficient film thickness, an inadequate film structure and a small amount of Cr content in the film.

The Japanese laid-open patent publications Hei.4-350180 discloses a method of reducing the discharge of gas components from the inside surface of the stainless steel tube for extra-high-purity gas. In this method, electro-polished stainless steel tubes on their inside surface, the so-called EP tubes, are sequentially connected to each other and subjected to a solution heat treatment, while continuously supplying hydrogen gas into the tube, in order to form a passive film consisting mainly of $Cr_2O_3$. According to this method, a uniform passive film can be easily formed. However, since a pretreatment, such as the electro-polishing for high cleanliness of the tube requires large manpower, the production costs increase.

DISCLOSURE OF THE INVENTION

The objective of the present invention is to provide a heat treatment method of a Ni-base alloy tube. In this method, it is possible to produce a Ni-base alloy tube, from which the Ni release is very small, while the tube is used in the environment of a high temperature water over a long period of time. Further, the method can be carried out at a low cost in an industrial scale, without a pretreatment, such as the electro-polishing of the inside surface of the tube, which increases the production cost.

The above-mentioned Ni-base alloy tube is a tube, which has an oxide film on its inside surface, and this film includes at least two layers. The first layer is mainly composed of $Cr_2O_3$, in which Cr in the total amount of metal elements is 50% or more, and the second layer is mainly composed of $MnCr_2O_4$, which exists outside the first layer. The crystal particle size of $Cr_2O_3$ of the first layer is 50 to 1000 nm and the total thickness of the oxide film is 180 to 1500 nm.

The gist of the present invention is a method of heat treatment for a Ni-base alloy tube described in the following (1) and (2). In the following descriptions "%" of component content is mass %, as long as not specified otherwise.

(1) A method of heat treatment for a Ni-base alloy tube, in which a tube to be treated is maintained at a temperature of 650 to 1200° C. for 1 to 1200 minutes in a continuous heat treatment furnace. The method is characterized by the following.

At least two gas supplying devices supply atmospheric gas, which consists of hydrogen or a mixed gas of hydrogen and argon, into the tube. Dew point of the atmospheric gas is in a range from −60° C. to +20° C. The gas supplying devices are provided on the outlet side of the continuous heat treatment furnace in order that they can move in the tube moving direction. Prior to putting the tube into the continuous heat treatment furnace, the atmospheric gas is supplied into the tube from its front end of its moving direction, using one of the gas supplying devices and a gas introducing pipe, which is arranged inside of the continuous heat treatment furnace. Thereafter the tube is put into the continuous heat treatment furnace.

After the front end of the tube reaches the outlet of the continuous heat treatment furnace, the supply of the atmospheric gas into the tube from one of the gas supplying devices is switched to the supply from the other gas supplying device. These operations are repeated.

The above-mentioned method is referred to as "the first heat treatment method" hereinafter.

(2) A method of heat treatment for a Ni-base alloy tube, in which a tube to be treated is maintained at a temperature of 650 to 1200° C. for 1 to 1200 minutes in a continuous heat treatment furnace. The method is characterized by the following.

At least one gas supplying device is respectively provided on the inlet side and the outlet side of the continuous heat treatment furnace in the tube moving direction. The gas supplying devices supply an atmospheric gas, which consists of hydrogen or a mixed gas of hydrogen and argon, into the tube. Dew point of the atmospheric gas is in a range from −60° C. to +20° C. Prior to putting the tube into the continuous heat treatment furnace, the atmospheric gas is supplied into the tube from its front end of its moving direction, using the gas supplying device provided on the inlet side of the continuous heat treatment furnace and a gas introducing pipe, which is longer than the tube and is arranged inside of the continuous heat treatment furnace.

After the front end of the tube reaches the outlet side of the continuous heat treatment furnace, the supply of the atmospheric gas into the tube is switched to the supply from the gas supplying device provided on the outlet side of the continuous heat treatment furnace. These operations are repeated.

The above-mentioned method is referred to as "the second heat treatment method" hereinafter.

Ni-base alloy tubes to be heat-treated in the first and the second heat treatment methods, are preferably Ni-base alloy tubes shown in the following (a) and (b).

(a) A Ni-base alloy consisting of C: 0.01 to 0.15%, Mn: 0.1 to 1.0%, Cr: 10 to 40%, Fe: 5 to 15% and Ti: 0 to 0.5%, preferably 0.1 to 0.5% and the balance Ni and impurities.

(b) A Ni-base alloy consisting of C: 0.015 to 0.025%, Si: 0.50% or less, Mn: 0.50% or less, Cr: 28.5 to 31.0%, Fe: 9.0 to 11.0%, and the balance 58.0% or more Ni and impurities, and Co, Cu, S, P, N, Al, B, Ti, Mo and Nb as the impurities being 0.020% or less, 0.10% or less, 0.003% or less, 0.015% or less, 0.050% or less, 0.40% or less, 0.005% or less, 0.40% or less, 0.2% or less and 0.1% or less, respectively.

After performing the first heat treatment method or the second heat treatment method, additional heat treatment maintaining the tube at a temperature of 650 to 750° C. for 300 to 1200 minutes may be carried out. It is preferable that the Ni-base alloy tube has been subjected to cold working prior to the heat treatment because the cold working has an effect of allowing Cr to diffuse easily in the inside surface layer of the Ni-base alloy tube, thereby accelerating the formation of oxide film in subsequent treatment.

BEST MODE FOR CARRYING OUT THE PREFERRED EMBODIMENT

The method of heat treatment, according to the present invention, will be described in detail with reference to attached drawings.

Figure 1:
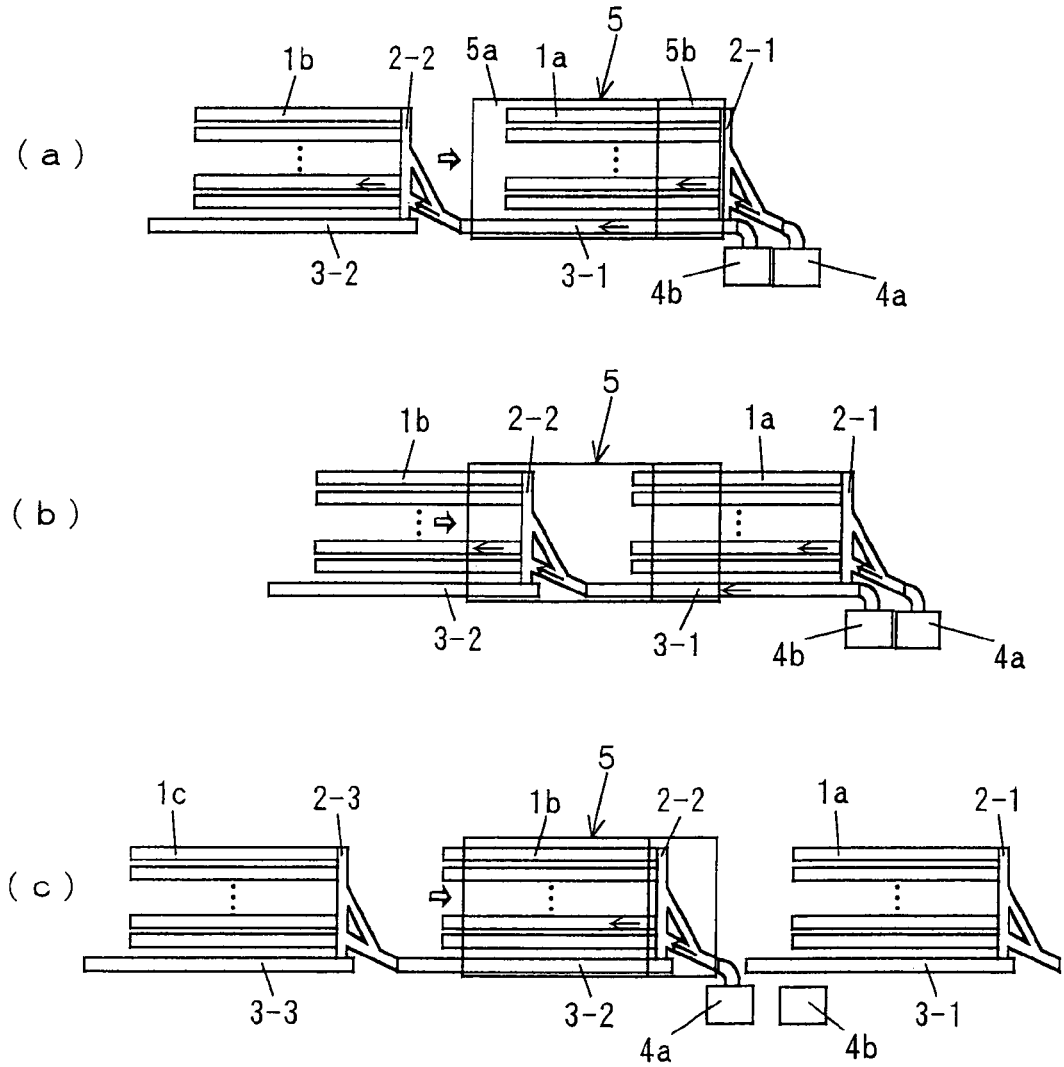
FIG. 1 is a plan view explaining the first heat treatment method of the present invention.

FIG. 1 is a plan view showing one embodiment of the first heat treatment method of the present invention. A plan view of a portion inside the furnace is included in FIG. 1. In particular, FIG. 1(*a*) shows an embodiment of the method of supply of the atmospheric gas in the tubes for group 1*a* of the preceding tubes during heat treatment and for the group 1*b* of the following tubes before heat treatment. FIG. 1(*b*) shows an embodiment of the supply of an atmospheric gas in the tubes for the group 1*a* of preceding tubes during heat treatment and for the group 1*b* of the subsequent tubes. FIG. 1(*c*) shows an embodiment of switching the supply of the atmospheric gas into the f tubes for the group 1*b* of the following tubes during heat treatment.

In FIG. 1, a continuous heat treatment furnace 5 (hereinafter referred to as "heat treatment furnace") comprises a heating zone 5*a* and a cooling zone 5*b*. The atmosphere in this heat treatment furnace 5 is an atmosphere of hydrogen gas and is set at a pressure slightly higher than the normal atmospheric pressure so that the air may not flow into the furnace.

An outlet side (right side in FIG. 1) of the heat treatment furnace 5 is provided with two gas supplying devices 4*a* and 4*b*. These gas supplying devices 4*a* and 4*b* are provided so that they can move in the same direction of the tubes in groups 1*a* and 1*b*, which are transferred in the direction of the large arrow. It should be noted that the gas supplying devices 4*a* and 4*b* are disposed at shifted positions in a vertical direction to the drawing sheet so as not to interfere with each other.

Figure 2:
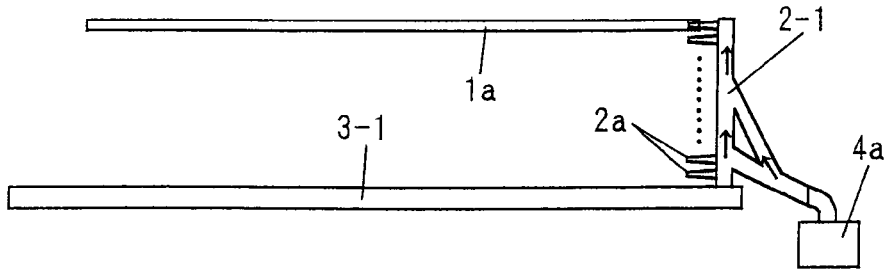
FIG. 2 is an enlarged plan view showing a gas introducing pipe and a header used in the first heat treatment method of the present invention.

As shown in FIG. 2 in an enlarged scale, the tapered nozzles 2*a* and a gas introducing tube 3-1 are attached to the header 2-1. The nozzle 2*a* of the header 2-1 is inserted into the front end of the tube in group 1*a*. The header 2-1 is connected to the gas supplying device 4*a*. As shown in FIG. 1 (*a*), a header 2-2 for the group of following tubes is connected to the gas supply device 4*b* through a gas introducing pipe 3-1. Therefore, in the state shown in FIG. 2, gas does not flow into the gas introducing pipe 3-1.

In the method shown in FIG. 1, the atmospheric gas, consisting of hydrogen or hydrogen and argon (hereinafter referred to as "atmospheric gas"), whose dew point is in a range of from −60° C. to +20° C., is supplied. Then the atmospheric gas is supplied from the gas supplying device 4*a* to the inside of the tube in group 1*a* during heat treatment. On the other hand, the atmospheric gas is supplied to the inside of a tube in group 1*b* before heat treatment from the gas supplying device 4*b*, through the gas introducing tube 3-1 attached to the header 2-1 (see FIG. 1(*a*)).

Then, while maintaining the above-mentioned state, the group 1*a* of the preceding tubes and the group 1*b* of the following tubes are transferred in the direction of the large arrow to perform heat treatment of both groups of tubes (see FIG. 1(*b*)).

After the front end of the following group 1*b* of tubes reached the outlet side of the heat treatment furnace 5, the following operations are carried out.

(1) The connection between the header 2-1 for the group 1*a* of the preceding tubes and the gas supplying device 4*a* is disengaged.

(2) The connection between the gas introducing tube 3-1, attached to the header 2-1 for the group 1*a* of the preceding tubes, and the header 2-2 for the group 1*b* of the following tubes is disengaged.

(3) The header 2-2 for the group 1*b* of the following tubes and the gas supplying device 4*a* are connected to each other. This means that the connecting partner of the group 1*b* of the following tubes is switched from the gas supplying device 4*b* to the gas supplying device 4*a*.

(4) The connection between the gas introducing pipe 3-1, attached to the header 2-1, and the gas supplying device 4*b* is disengaged.

(5) In order to supply the atmospheric gas to the inside of the group 1*c* of the following tubes, the gas supplying device 4*b* is on standby to connect it to the gas introducing pipe 3-2 attached to the header 2-2 (see FIG. 1(*c*)).

Figure 3:
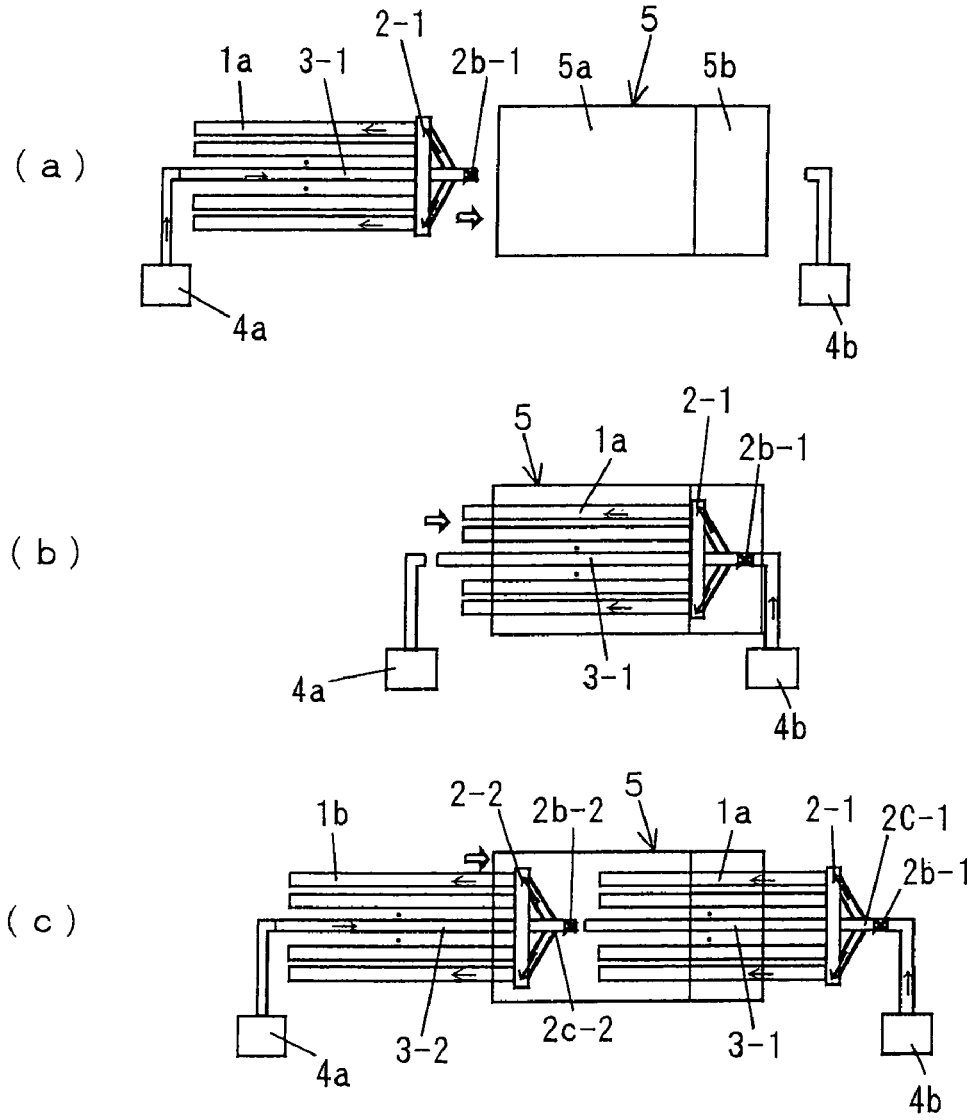
FIG. 3 is a plan view explaining the second heat treatment method of the present invention.

FIG. 3 is the same plan view as FIG. 1, showing one embodiment of the second heat treatment method of the present invention. FIG. 3(*a*) shows an embodiment of the supply of the atmospheric gas into the tubes of group 1*a* of the preceding tubes, before treatment. FIG. 3(*b*) shows a switching embodiment of the supply of the atmospheric gas to the insides of tubes of the group 1*a* of the preceding tubes during heat treatment. FIG. 3(*c*) shows an embodiment of the supply of the atmospheric gas into the tubes of group 1*a* of the preceding tubes and the group 1*b* of the following tubes, during heat treatment.

In FIG. 3, the heat treatment furnace 5 is the same furnace as shown in FIG. 1. In this method, the gas supplying devices 4*a* and 4*b* are respectively provided in the inlet side (left side in FIG. 3) and the outlet side (right side in FIG. 3) of the heat treatment furnace 5, unlike of FIG. 1. These gas supplying devices 4*a* and 4*b* can move in the same direction of the groups 1*a* and 1*b* of tubes, which are transferred in the direction of the large arrow.

Figure 4:
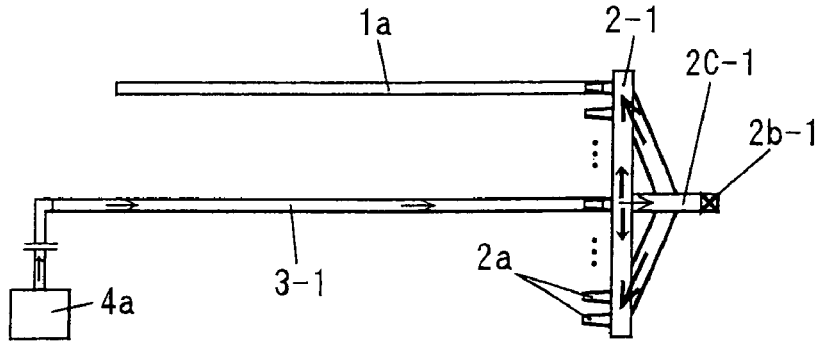
FIG. 4 is an enlarged plan view showing a gas introducing pipe and a header used in the second heat treatment method of the present invention.

FIG. 4 is an enlarged plan view of a part of FIG. 1(*a*). As shown in FIG. 4, tapered nozzles 2*a* of the header 2-1 are inserted into the front ends of the respective tubes of the group 1*a* before heat treatment. The header 2-1 has a protruded portion 2*c*-1, which is located in the center portion in a longitudinal direction. A cock 2*b*-1 is attached to the right end of the protruded portion. Gas is supplied to the respective tubes from the gas supplying device 4*a* through the gas introducing pipe 3-1. To the inside of the left end of the gas introducing pipe 3-1 a check valve (not shown) may be attached, which allows gas to flow only in the direction of the arrows. However, the check valve is not necessary.

In the method shown in FIG. 3, the same atmospheric gas, as mentioned above, is supplied to the tubes in the group 1*a*, prior to heat treatment of the tube, from the gas supplying device 4*a*, through the gas introducing tube 3-1, and the header 2-1 that is closed by the cock 2*b*-1 (see FIG. 3(*a*)).

While maintaining the above-mentioned state, the tubes of the group 1*a* are moved in the direction of the large arrow and put into the heat treatment furnace 5 and heat-treated. After the front ends of the tubes of the group 1*a* reach the outlet side of the heat treatment furnace 5, the supply of the atmospheric gas to the inside of the tubes is switched from the gas supplying device 4*a* on the inlet side to the gas supplying device 4*b* on the outlet side, as shown in FIG. 3(*b*). In this case, the cock 2*b*-1, attached to the right end of the protruded portion 2*c*-1 of the header 2-1 is opened. On the other hand, the gas supplying device 4*a*, on the inlet side, is necessary for the supply of the atmospheric gas to the inside of the tubes in the following group.

FIG. 3(*c*) shows an embodiment where the group 1*b* of the following tubes, which is supplied with the atmospheric gas from the gas supplying device 4*a*, on the inlet side, and the group 1*a* of the preceding tubes, which is supplied with the atmospheric gas from the gas supplying device 4*b*, on the outlet side, are simultaneously heat-treated.

In the methods shown in FIG. 1 and FIG. 3, when the lengths of the tubes are very short, two or more tubes can be connected to each other by use of a coupler, so that the group 1*a* (1*b*, 1*c*) may be composed of the connected tubes. A desirable coupler is such one as the end portions of the tubes can be inserted into the inside of it.

In the methods shown in FIG. 1 and FIG. 3, the set of the header 2 and the gas introducing pipe 3 is repeatedly used.

As described above, by causing the atmospheric gas to flow into the tubes before entering the heat treatment furnace, the air in the tubes is purged. Therefore, the desirable oxide film is formed on the inside surface of the tube during heat treatment.

The atmospheric gas flows into the tube in the opposite direction to the tube moving direction in the heat treatment furnace also. Therefore, the residuals in the tube, which has been cleaned but not-heat-treated, are vaporized in the high-temperature portion of the tube during the heat treatment and discharged from the tube. The vaporized residuals in the tube are carried by gas flow in the tube to reach a non-heated area, and they may occasionally solidify again and be deposited on the inside surface of the tube. However, the deposit of residuals are heated and vaporized again due to the direction of the gas flow mentioned above. Accordingly the all of the residuals can finally be discharged from the tube. As a result, even if the previous electro-polishing is not performed, unlike the EP tube, a uniform oxide film, having a required performance, is formed on the inside surface of the tube.

The reason why hydrogen or the mixed gas of hydrogen and argon, whose dew point is in a range of from −60° C. to +20° C., should be used as the atmospheric gas, and the reason why the tube should be heat-treated at a temperature of 650 to 1200° C. for 1 to 1200 minutes will now be explained.

1. Atmospheric Gas

In order to form the above-described oxide film on the inside surface of the Ni-base alloy tube, the selection of a heat-treating atmosphere is important, and the heat-treating atmosphere must be an atmosphere of hydrogen gas or a mixed gas of hydrogen and argon. Further, in order to make the above-described oxide film compact, water vapor must be contained in the above-described atmosphere. The amount of water vapor must be in a range of from −60° C. to +20° C. when expressed by the dew point of the mixture. A desirable range of the dew point is from −30° C. to +20° C. for a hydrogen atmosphere containing 0 to 10 volume % argon, or from −50° C. to 0° C. for a hydrogen atmosphere containing 10 to 80 volume % argon.

2. Heat treating conditions (temperature and time)

It is necessary to control the heat-treating temperature and time in order to obtain the required structure and thickness of the oxide film. This structure and thickness of the oxide film will be described later.

First, it is necessary to select an adequate temperature range, where $Cr_2O_3$ is consistently and effectively formed. The temperature range is 650 to 1200° C. When the temperature is lower than 650° C., $Cr_2O_3$ is not efficiently formed. On the other hand, when the temperature exceeds 1200° C., the generated $Cr_2O_3$ becomes non-uniform due to the grain growth and the compactness of the film is lost so that the oxide film is not suitable for preventing the Ni release.

The heat-treating time is an important factor that affects the film thickness. The heat-treating time of shorter than 1 minute does not form a uniform film in which the first layer of the oxide film, mainly composed of $Cr_2O_3$, has a thickness of 170 nm or more. On the other hand, a long heat-treating time exceeding 1200 minutes makes the thickness of the first layer of the oxide film thicker than 1200 nm. Further, if the total thickness of the oxide film exceeds 1500 nm, the film is liable to peel off and the effect of the film to prevent of the Ni release decreases.

It is recommendable that tubes to be treated (Ni-base alloy tubes) are subjected to cold working prior to the above-mentioned heat treatment. The reason for this is that the formation of an oxide film on a cold-worked surface becomes easier and the oxide film can become compact. It is desirable that the working ratio of the cold working is 30% or more. Although the upper limit of the working ratio is not restricted, an actual upper limit is 90%, which is possible in the conventional technology. The cold working can be either cold extrusion or cold rolling.

After the heat treatment for the formation of the oxide film, a so-called "TT" (thermal treatment) may be performed. This treatment makes it possible to enhance corrosion resistance, particularly stress corrosion cracking resistance, of the Ni-base alloy tube in high temperature water. The heat-treating temperature is preferably 650 to 750° C. and the treating time is preferably 300 to 1200 minutes. Further, since the treatment conditions overlap with the conditions of the treatment for forming the oxide film, the "TT" can be replaced for the treatment of forming the oxide film 3. Ni-base alloy for the tube The material of the Ni-base alloy tube according to the present invention is an alloy whose principal component is Ni. In particular, an alloy consisting of C: 0.01 to 0.15%, Mn: 0.1 to 1.0%. Cr: 10 to 40%, Fe: 5 to 15% and Ti: 0 to 0.5%, and the balance Ni and impurities, is preferred. The reasons are as follows.

C (Carbon) is preferably contained in an alloy by 0.01% or more to enhance the grain boundary strength of the alloy. On the other hand, in order to obtain excellent stress corrosion cracking resistance, the amount of C is preferably 0.15% or less, more preferably 0.01 to 0.06%, and most preferably 0.015 to 0.025%.

Mn (Manganese) is preferably contained in the alloy by 0.1% or more for forming the film whose second layer is mainly composed of $MnCr_2O_4$. However, when Mn exceeds 1.0%, it reduces the corrosion resistance of the alloy. The preferable upper limit is 0.50%.

Cr (Chromium) is an element, which is necessary for forming an oxide film, which prevents the metal release. Cr of 10% or more is necessary to form such an oxide film. However, when Cr exceeds 40%, since the Ni content inevitably decreases, the corrosion resistance of the alloy deteriorates. The preferable range of the Cr content is 28.5 to 31.0%.

Fe (Iron) is an element, which is solid-soluble in Ni and can be used in place of a part of the expensive Ni. It is desirable that 5% or more Fe is contained. However, when Fe exceeds 15%, the corrosion resistance of the Ni-base alloy is lost. The preferable range of Fe is 9.0 to 11.0%.

Ti (Titanium) has an effect to enhance the workability of the alloy and it can be added as required. In order to obtain a remarkable effect, it is preferred that the alloy contains 0.1% or more Ti. However, when it exceeds 0.5%, the cleanliness of the alloy is lost, so the preferable upper limit is 0.40%.

The component other than the above-mentioned ones is substantially Ni. In order to make the Ni-base alloy excellent in corrosion resistance, the Ni content is preferably 45 to 75%, and more preferably 58 to 75%. Regarding impurities, it is preferred that Si is 0.50% or less, P is 0.030% or less, more preferably 0.015% or less, S is 0.015% or less, more preferably 0.003% or less, Co is 0.020% or less, more preferably 0.014% or less, Cu is 0.50% or less, more preferably 0.10% or less, Ni is 0.050% or less, Al is 0.40% or less, B is 0.005% or less, Mo is 0.2% or less, and Nb is 0.10% or less.

Three kinds of typical alloy of the above-described Ni-base alloys are explained below.

(1) An alloy consisting of C: 0.15% or less, Si: 0.50% or less, Mn: 1.00% or less, P: 0.030% or less, S: 0.015% or less, Cr: 14.00 to 17.00%, Fe: 6.00 to 10.00%, Cu: 0.50% or less, and Ni: 72.00% or more.

(2) An alloy consisting of C: 0.05% or less, Si: 0.50% or less, Mn: 0.50% or less, P: 0.030% or less, S: 0.015% or less, Cr: 27.00 to 31.00, Fe: 7.00 to 11.00%, Cu: 0.50% or less, and Ni: 58.00% or more.

(3) An alloy consisting of C: 0.015 to 0.025%, Si: 0.50% or less, Mn: 0.50% or less, P: 0.015% or less, S: 0.003% or less, Cr: 28.5 to 31.0%, Fe: 9.0 to 11.0%, Co: 0.020% or less, Cu: 0.10% or less, N: 0.050% or less, Al: 0.40% or less, B: 0.005% or less, Ti: 0.40% or less, Mo: 0.2% or less, Nb: 0.1% or less, and Ni: 58.0% or more.

4. Oxide film (1) Structure of oxide film

Figure 5:
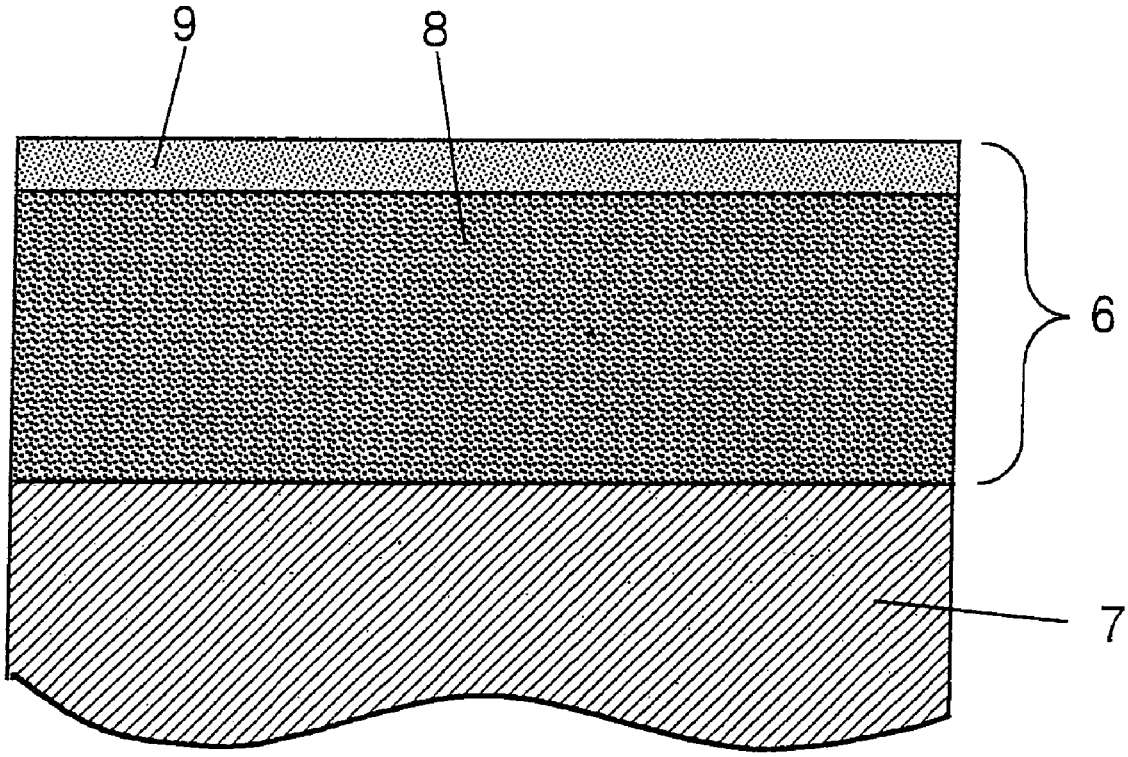
FIG. 5 is a view schematically showing a cross-section in the vicinity of the inside surface of the Ni-base alloy tube obtained by the heat treatment method of the present invention.

FIG. 5 schematically shows a cross-section in the vicinity of the inside surface of the Ni-base alloy tube heat-treated in the method according to the present invention. As shown in FIG. 5, the inside surface of the Ni-base alloy tube has an oxide film 6. The oxide film consists substantially of the first layer 8, which is near the base material 7, and the second layer 9, which is outside the first layer 8. The first layer is mainly composed of $Cr_2O_3$ and the second layer 9 is mainly composed of $MnCr_2O_4$.

Figure 6:
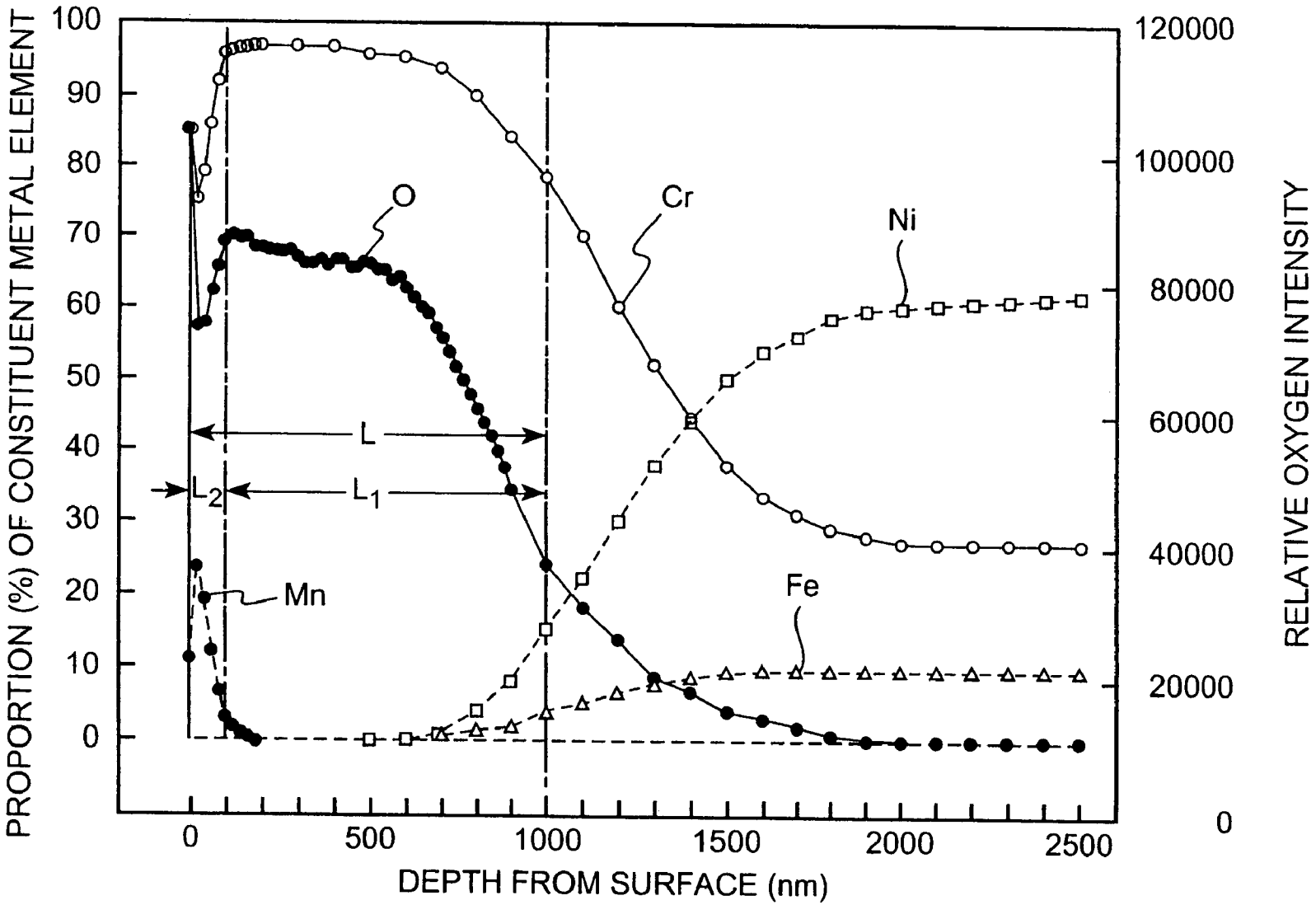
FIG. 6 is a view showing one example of SIMS analysis results in the vicinity of the inside surface of the Ni-base alloy tube obtained by the heat treatment method of the present invention.

FIG. 6 is an analysis result according to Secondary Ion Mass Spectroscopy (SIMS) method of samples, in which the oxide film was formed on the inside surface of the Ni-base alloy tube made from the alloy of 29.3% Cr, 9.7% Fe and the balance Ni. In FIG. 6, a portion, where the constituent ratio of Cr is high, is the first layer, whose principal component is $Cr_2O_3$, and the outermost layer, where the constituent ratio of Mn is high, is the second layer, whose main component is $MnCr_2O_4$. Although oxides of Mn, Al, Ti and the like can be contained in these layers, amounts thereof are small.

The oxide film should be such that the diffusion rate of Ni in the film is small. Further, even when the oxide film is broken during the use of the tube, it must be reproduced immediately. In order to have such a function, the oxide film must have the above-mentioned structure. Furthermore, Cr content, the compactness and thickness of the first layer, mainly composed of $Cr_2O_3$, must be appropriate.

Low prevention effect of the metal release in the oxide film of the conventional Ni-base alloy is due to the low ratio of $Cr_2O_3$ in the oxide film, a thin $Cr_2O_3$ film thickness and a low compactness of $Cr_2O_3$.

(2) Cr content in the first layer

A factor which has influence on the amount of the Ni release from a Ni-base alloy in a high-temperature water environment, is the Cr content in the oxide film of the first layer. The amount of Ni release becomes small when the Cr content in the first layer is 50% or more and the thickness and the compactness of the film are in a certain desirable range. The larger the Cr content the larger the prevention effect of the release, thus, a desirable Cr content is 70% or more.

The above-mentioned Cr content means the mass % of Cr, when the total amount of all metal components in the first layer, i.e., the film mainly composed of $Cr_2O_3$, is defined as 100. In the present specification the film having a Cr content of 50% or more is defined as the "film mainly composed of $Cr_2O_3$".

(3) Crystal particle size of $Cr_2O_3$ in the first layer

The crystal particle size of $Cr_2O_3$ is important as a criterion of the compactness of the oxide film. When the inside surface of the Ni-base alloy tube is exposed to a high-temperature water environment, Ni is released from the base material through the $Cr_2O_3$ film. At that time Ni moves and diffuses through grain boundaries of $Cr_2O_3$. When the particle size of $Cr_2O_3$ is smaller than 50 nm, the crystal grain boundaries increase so that the diffusion of Ni may be promoted, i.e., Ni can be released easily. Therefore, the lower limit of the grain size of $Cr_2O_3$ is 50 nm.

Even if the $Cr_2O_3$ oxide film is uniformly formed on the inside surface of the Ni-base alloy tube, a breakage of the $Cr_2O_3$ oxide film is generated for various reasons. When the breakage occurs, Ni is released from the broken portion, even if the rate is smaller than in the case of no oxide film. The reasons for the breakage of $Cr_2O_3$ film are roughly as follows. One reason is an external force loaded on the tube during the manufacturing and during usage. A typical example of the external force during manufacturing is the force of the bending work. The external force during usage involves the force due to vibration and the like. The second reason is the stress based on the difference between the coefficients of thermal expansion of the tube material and the oxide film.

There is a difference between the coefficients of thermal expansion of the Ni-base alloy and the oxide film. Accordingly, when the tube is cooled to a room temperature after formation of the oxide film on its inside surface at a high temperature, compression stress is generated in the oxide film and tensile stress is generated in the tube material. When the crystal particle size of $Cr_2O_3$ is coarse, such as exceeding 1000 nm, the strength of $Cr_2O_3$ decreases, and the resisting force against the breakage of the film, by the above-mentioned stress, becomes less.

The grain size of $Cr_2O_3$ can be measured as follows. The Ni-base alloy tube is dissolved in the bromine-methanol solution, for example. Thereafter, three fields of the base metal side of the remaining oxide film are observed by magnitude of 20,000 under Field Emission Gun-Scanning Electron Microscope (FE-SEM). An average of the short diameter and the long diameter of the respective crystals is defined as the grain size of one crystal grain. Then the average of the grain sizes is calculated. The obtained value is the crystal grain size of $Cr_2O_3$.

(4) Film thickness of the first layer and total thickness of the oxide film

Oxides, which can be used as oxide films for preventing the Ni release from the inside surface of the Ni-base alloy tube, are $TiO_2$, $Al_2O_3$ and $Cr_2O_3$. Any of these oxides has comparatively small solubility in high-temperature water, therefore, if a compact oxide film is formed, it is effective in the prevention of the Ni release. However, when Ti, Al and the like are present in a large amount in the Ni-base alloy, a large amount of intermetallic compounds and inclusions exists in the alloy, which undesirably affects on its workability and corrosion resistance. Therefore, according to the present invention, the oxide film mainly composed of $Cr_2O_3$ is intentionally generated on the inside surface of the Ni-base alloy tube.

The Ni release from the inside surface of the Ni-base alloy tube in a high-temperature water environment is influenced by the thickness of the film principally consisting of $Cr_2O_3$. The effective thickness of the film mainly composed of $Cr_2O_3$ for the prevention of the Ni release is 170 to 1200 nm. When the film thickness is less than 170 nm, the film is broken in a comparatively short time and the Ni release starts early. On the other hand, when the film thickness exceeds 1200 nm, cracking is liable to occur in the film during bending work. Therefore, the thickness of the film mainly composed of $Cr_2O_3$ is preferably 170 to 1200 nm.

Since there is the difference in the coefficients of thermal expansion between the base material and the oxide film as described above, cracking is generated in the film and the film tends to peel off when the total thickness of the oxide film exceeds 1500 nm. Accordingly, the upper limit of the total thickness of the oxide film should be 1500 nm. The preferable minimum value of the total thickness is 180 nm, which is the total value of the desirable lower limit value of the first layer and the desirable lower limit value of the second layer, which will be described hereinafter.

In FIG. 6, the total thickness of the film thickness is a distance (L) from a position (shown by a broken line in FIG. 6) where the relative strength of oxygen (O) reaches half of the maximum value to the left end in FIG. 6. The thickness ($L_1$), which is obtained by subtraction of the thickness ($L_2$) of the following second layer from L, is the thickness of the first layer.

(5) The second layer mainly composed of $MnCr_2O_4$

The second layer is an oxide film mainly composed of $MnCr_2O_4$. This layer is formed by diffusion of Mn contained in the base material to the outer layer. Mn has lower free energy of oxide formation and is more stable at high partial pressure of oxygen as compared with Cr. Thus, $Cr_2O_3$ is preferentially generated in the vicinity of the base material and $MnCr_2O_4$ is generated in the outer layer. The reason why an oxide containing only Mn is not generated is that $MnCr_2O_4$ is stable in this environment and the amount of Cr is sufficient. Although Ni and Fe also have low free energy of oxide formation, they do not form such a layered oxide film due to their small diffusion rate.

The $Cr_2O_3$ film is protected by $MnCr_2O_4$ in the atmosphere of the tube usage. Further, even if the $Cr_2O_3$ film is broken for any reason, repairing of the $Cr_2O_3$ film is accelerated by the presence of $MnCr_2O_4$. In order to obtain such an effect it is preferable that the $MnCr_2O_4$ film exists in a thickness of about 10 to 200 nm.

When the Mn content in the base material increases, $MnCr_2O_4$ can be positively produced. Nevertheless, when Mn in the alloy increases too much, it deteriorates corrosion resistance and makes manufacturing cost higher. Therefore, it is preferable that the Mn content in the base material is 0.1 to 1.0% as mentioned above. A particularly desirable range of the Mn content is 0.20 to 0.40%.

5. Manufacturing method of the Ni-base alloy tube

The Ni-base alloy tube, which should be heat-treated in the method of the present invention, can be manufactured by melting a Ni-base alloy having the required chemical composition to make an ingot, then usually performing a step of hot working and annealing, or a step of hot working, cold working and annealing. Further, in order to improve the corrosion resistance of the base material, the TT may be carried out.

The heat treatment method of the present invention may be performed after the conventional annealing or in place of the conventional annealing. If the heat treatment is performed in place of the conventional annealing, the heat treatment step for forming the oxide film, in addition to the conventional manufacturing steps, is not necessary and the manufacturing cost does not increase. Alternatively, when the TT is performed after the annealing, the TT may be performed in place of the heat treatment for forming the oxide film. Further, both annealing and the TT may be used as the treatment of forming the oxide film.

EXAMPLES

The present invention will be described in detail by examples hereinafter.

Alloys having chemical compositions shown in Table 1 were melted in a vacuum and ingots were obtained. Tubes having predetermined sizes were produced from the ingots in the following process.

The ingots were hot-forged into billets, and the tubes were produced from the billets by the hot-extrusion method. These tubes were further worked into tubes for extrusion by cold rolling with the cold pilger mill. The tubes for extrusion have an outer diameter of 23.0 mm and a wall thickness of 1.4 mm. After being annealed in a hydrogen atmosphere at 1100° C., the tubes were worked into the final tubes in the cold extrusion process. Each of the tubes has a size with an outer diameter of 16.0 mm, a wall thickness of 1.0 mm and a length of 18000 mm. The reduction ratio was 50%.

Then, the outside and inside surfaces of the respective tubes were washed by an alkaline degreasing liquid and rinsed by water. After that they were subjected to heat treatment tests of the respective conditions shown in Table 2 to form the oxide film consisting of the above-mentioned two layers on each inside surface.

The supply of the atmospheric gas into the tubes was carried out by the method shown in FIG. 3. Twenty-one tubes were simultaneously treated. However, for a tube of the test No. 12, the header 2 was arranged on the rear end of the tube and the atmospheric gas was supplied in the opposite direction to that in the method of the present invention. The supplying rate of the atmospheric gas was 7 $Nm^3/h$ in total of twenty-one tubes in any case.

TABLE 1

| Chemical Composition (mass %, bal.: Ni and impurities) | | | | | | | | | |
|---|---|---|---|---|---|---|---|---|---|
| Alloy | C | Si | Mn | P | S | Cr | F | Ti | Co |
| A | 0.015 | 0.23 | 0.25 | 0.002 | 0.001 | 29.0 | 9.5 | 0.19 | 0.01 |
| B | 0.021 | 0.25 | 0.27 | 0.012 | 0.001 | 15.9 | 8.4 | 0.20 | 0.01 |

Test pieces were taken from the respective heat-treated tubes. Oxide films formed on the inside surfaces of the test pieces were examined by SIMS so that the thickness of the first layer (oxide film mainly composed of $Cr_2O_3$) and the thickness of the second layer (oxide film mainly composed of $MnCr_2O_4$) were inspected. Further, the test pieces were immersed in a bromine-methanol solution and separated oxide films were observed by FE-SEM so that the grain size of the $Cr_2O_3$ were inspected.

The test pieces were subjected to a releasing test in order to determine an amount of released ions. In the releasing test the amount of released Ni ions in pure water were measured by use of an autoclave. In the test, the pure water in the test piece was insulated with plugs of titanium so that the water in the test piece could not be contaminated by the ions released from any member of the apparatus. The test temperature was set at 320° C. and the test pieces were immersed in the pure water for 1000 hours.

After completing the tests, the liquid was immediately analyzed by Inductively Coupled Plasma Emission Spectrometry (ICP) method and an amount of the dissolved Ni ions was determined. Results of the above-mentioned tests were shown in Table 2.

TABLE 2

| Conditions for Film Forming | | | | | | | | Film Structure | | | | | |
|---|---|---|---|---|---|---|---|---|---|---|---|---|---|
| | | | | Gas Composition (vol. %) | | | | First Layer (Film composed of mainly $Cr_2O_3$) | | | Second Layer (Film composed of mainly $MnCr_2O_4$) | Total Film Thickness | Amount of Ni Release |
| Test No. | Alloy | Temperature (° C.) | Time (min.) | $H_2$ | Ar | Gas Flow | Dew Point (° C.) | Cr Content (mass %) | Grain Size (nm) | Thickness (nm) | Thickness (nm) | (nm) | (ppm) |
| | | | | | | | This invention | | | | | | |
| 1 | A | 1100 | 5 | 100 | | T→B | −5 | 92 | 320 | 810 | 110 | 920 | 0.01 |
| 2 | A | 1100 | 5 | 100 | | T→B | −35 | 84 | 270 | 440 | 55 | 495 | 0.03 |
| 3 | A | 700 | 900 | 100 | | T→B | −15 | 87 | 290 | 670 | 80 | 750 | 0.02 |
| 4 | A | 1100 | 5 | 80 | 20 | T→B | 15 | 93 | 340 | 930 | 120 | 1050 | 0.01 |
| 5 | A | 1100 | 5 | 80 | 20 | T→B | −15 | 88 | 280 | 520 | 60 | 580 | 0.03 |
| 6 | B | 920 | 3 | 100 | | T→B | −35 | 85 | 240 | 470 | 50 | 520 | 0.03 |
| 7 | B | 920 | 3 | 80 | 20 | T→B | 15 | 92 | 300 | 710 | 80 | 790 | 0.02 |
| | | | | | | | Comparative Example | | | | | | |
| 8 | A | 1100 | 5 | 100 | | T→B | *−65 | *37 | 80 | 20 | 25 | *45 | 0.93 |
| 9 | A | *1250 | 3 | 80 | 20 | T→B | 15 | 93 | *1080 | 1310 | 320 | *1650 | 0.41 |

TABLE 2-continued

| Conditions for Film Forming | | | | | | | | Film Structure | | | | | |
|---|---|---|---|---|---|---|---|---|---|---|---|---|---|
| | | | | Gas Composition (vol. %) | | | Dew | First Layer (Film composed of mainly $Cr_2O_3$) | | | Second Layer (Film composed of mainly $MnCr_2O_4$) | Total Film Thickness | Amount of Ni |
| Test No. | Alloy | Temperature (° C.) | Time (min.) | $H_2$ | Ar | Gas Flow | Point (° C.) | Cr Content (mass %) | Grain Size (nm) | Thickness (nm) | Thickness (nm) | (nm) | Release (ppm) |
| 10 | A | 1100 | *1440 | 80 | 20 | T→B | 15 | 96 | 750 | 1460 | 290 | *1750 | 0.29 |
| 11 | A | 1100 | 5 | 80 | 20 | T→B | *30 | 95 | 350 | 1520 | 330 | *1850 | 0.35 |
| 12 | A | 1100 | 5 | 80 | 20 | *B→T | 15 | 96 | 370 | 1210 | 370 | *1580 | 0.17 |

Note 1)
In the column of "Gas Flow", "T→B" means the flow from the top to the bottom of the tube, and "B→T" means the flow from the bottom to the top of the tube.
Note 2)
*indicates outside the condition of this invention.

As shown in Table 2, the amounts of released Ni of tests Nos. 1 to 7 of heat-treated tubes in accordance with the method of the present invention are in a range of 0.01 to 0.03 ppm, which is remarkably small.

On the contrary, the amounts of released Ni of tests Nos. 8 to 11 of the comparative examples were in a range of 0.29 to 0.93 ppm. In these comparative examples although the atmospheric gas supplying method was used in the method of the present invention, any one of the dew point of the atmospheric gas and the heat-treating temperature and time was outside the conditions defined in the present invention. The amount of released Ni of test No. 12 of the comparative example was 0.17 ppm. In this test, all of the dew point of the atmospheric gas and the heat-treating temperature and time satisfy the conditions defined in the present invention, but the atmospheric gas supplying direction was opposite to that in the method of the present invention.

INDUSTRIAL APPLICABILITY

According to the heat treatment method of the present invention, the two layered oxide film, which suppresses the Ni release in the environment of high-temperature pure water, can be reliably and efficiently formed on the inside surface of the tube. Therefore, a Ni-base alloy tube, having high quality, which is suitable for being used as the atomic reactor structural member, can be provided at low costs.

The invention claimed is:

1. A method of heat treatment for a Ni-base alloy tube, in which the tube is maintained at a temperature of 650 to 1200° C. for 1 to 1200 minutes in a continuous heat treatment furnace, characterized in that:

at least two gas supplying devices for supplying an atmospheric gas consisting of hydrogen or a mixed gas of hydrogen and argon, whose dew point is in a range from −60° C. to +20° C., are provided on the outlet side of the continuous heat treatment furnace, so that they can move in the tube moving direction;

prior to putting the tube into the continuous heat treatment furnace, the atmospheric gas is supplied into the tube from the front end of the tube moving direction by use of one of the gas supplying devices and a gas introducing pipe, which is arranged inside of the continuous heat treatment furnace;

the tube is put into the continuous heat treatment furnace while being supplied with the atmospheric gas;

after the front end of the tube reaches the outlet side of the continuous heat treatment furnace, the supply of the atmospheric gas from the one gas supplying device is switched to the supply from the other gas supplying device.

2. A method of heat treatment according to claim 1, characterized by maintaining the Ni-base alloy tube at a temperature of 650 to 750° C. for 300 to 1200 minutes, after the heat treatment of maintaining the tube at a temperature of 650 to 1200° C. for 1 to 1200 minutes.

3. A method of heat treatment according to claim 1, characterized in that the Ni-base alloy tube to be heat-treated is a cold-worked tube.

4. A method of heat treatment for a Ni-base alloy tube consisting of, by mass %, C: 0.01 to 0.15%, Mn: 0.1 to 1.0%, Cr: 10 to 40%, Fe: 5 to 15% and Ti: 0 to 0.5%, and the balance Ni and impurities, in which the tube is maintained at a temperature of 650 to 1200° C. for 1 to 1200 minutes in a continuous heat treatment furnace, characterized in that:

at least two gas supplying devices for supplying an atmospheric gas consisting of hydrogen or a mixed gas of hydrogen and argon, whose dew point is in a range from −60° C. to +20° C., are provided on the outlet side of the continuous heat treatment furnace, so that they can move in the tube moving direction;

prior to putting the tube into the continuous heat treatment furnace, the atmospheric gas is supplied into the tube from the front end of the tube moving direction by use of one of the gas supplying devices and a gas introducing pipe, which is arranged inside of the continuous heat treatment furnace;

the tube is put into the continuous heat treatment furnace while being supplied with the atmospheric gas;

after the front end of the tube reaches the outlet side of the continuous heat treatment furnace, the supply of the atmospheric gas from the one gas supplying device is switched to the supply from the other gas supplying device.

5. A method of heat treatment according to claim 4, characterized by maintaining the Ni-base alloy tube at a temperature of 650 to 750° C. for 300 to 1200 minutes, after the heat treatment of maintaining the tube at a temperature of 650 to 1200° C. for 1 to 1200 minutes.

6. A method of heat treatment according to claim 4, characterized in that the Ni-base alloy tube to be heat-treated is a cold-worked tube.

7. A method of heat treatment for a Ni-base alloy tube, in which the tube is maintained at a temperature of 650 to 1200° C. for 1 to 1200 minutes in a continuous heat treatment furnace, characterized in that:

at least one gas supplying device for supplying an atmospheric gas, which consists of hydrogen or a mixed gas of hydrogen and argon, and whose dew point is in a range from −60° C. to +20° C., is respectively provided on the inlet side and the outlet side of the continuous heat treatment furnace, so that they can move in the tube moving direction;

prior to putting the tube into the continuous heat treatment furnace, the atmospheric gas is supplied into the tube from the front end of the tube moving direction by use of the gas supplying device provided on the inlet side of the continuous heat treatment furnace and a gas introducing pipe, which is longer than the tube and is arranged inside of the continuous heat treatment furnace;

the tube is put into the continuous heat treatment furnace while supplying the atmospheric gas;

after the front end of the tube reaches the outlet side of the continuous heat treatment furnace, the supply of the atmospheric gas from the gas supplying device, provided on the inlet side of the continuous heat treatment furnace, is switched to the supply from the gas supplying device, provided on the outlet side of the continuous heat treatment furnace.

8. A method of heat treatment according to claim 7, characterized by maintaining the Ni-base alloy tube at a temperature of 650 to 750° C. for 300 to 1200 minutes, after the heat treatment of maintaining the tube at a temperature of 650 to 1200° C. for 1 to 1200 minutes.

9. A method of heat treatment according to claim 7, characterized in that the Ni-base alloy tube to be heat-treated is a cold-worked tube.

10. A method of heat treatment for a Ni-base alloy tube consisting of, by mass %, C: 0.01 to 0.15%, Mn: 0.1 to 1.0%, Cr: 10 to 40%, Fe: 5 to 15% and Ti: 0 to 0.5%, and the balance Ni and impurities, in which the tube is maintained at a temperature of 650 to 1200° C. for 1 to 1200 minutes in a continuous heat treatment furnace, characterized in that:

at least one gas supplying device for supplying an atmospheric gas, which consists of hydrogen or a mixed gas of hydrogen and argon, and whose dew point is in a range from −60° C. to +20° C., is respectively provided on the inlet side and the outlet side of the continuous heat treatment furnace, so that they can move in the tube moving direction;

prior to putting the tube into the continuous heat treatment furnace, the atmospheric gas is supplied into the tube from the front end of the tube moving direction by use of the gas supplying device provided on the inlet side of the continuous heat treatment furnace and a gas introducing pipe, which is longer than the tube and is arranged inside of the continuous heat treatment furnace;

the tube is put into the continuous heat treatment furnace while supplying the atmospheric gas;

after the front end of the tube reaches the outlet side of the continuous heat treatment furnace, the supply of the atmospheric gas from the gas supplying device, provided on the inlet side of the continuous heat treatment furnace, is switched to the supply from the gas supplying device, provided on the outlet side of the continuous heat treatment furnace.

11. A method of heat treatment according to claim 10, characterized by maintaining the Ni-base alloy tube at a temperature of 650 to 750° C. for 300 to 1200 minutes, after the heat treatment of maintaining the tube at a temperature of 650 to 1200° C. for 1 to 1200 minutes.

12. A method of heat treatment according to claim 10, characterized in that the Ni-base alloy tube to be heat-treated is a cold-worked tube.

13. A method of heat treatment according to claim 1, wherein the method is repeated using another Ni-base alloy tube.

14. A method of heat treatment according to claim 4, wherein the method is repeated using another Ni-base alloy tube.

15. A method of heat treatment according to claim 7, wherein the method is repeated using another Ni-base alloy tube.

16. A method of heat treatment according to claim 10, wherein the method is repeated using another Ni-base alloy tube.

17. A method of heat treatment according to claim 1, wherein the Ni-base alloy tube is part of a group of tubes undergoing the same heat treatment and the heat treatment is repeated on a second group of Ni-base alloy tubes.

18. A method of heat treatment according to claim 4, wherein the Ni-base alloy tube is part of a group of tubes undergoing the same heat treatment and the heat treatment is repeated on a second group of Ni-base alloy tubes.

19. A method of heat treatment according to claim 7, wherein the Ni-base alloy tube is part of a group of tubes undergoing the same heat treatment and the heat treatment is repeated on a second group of Ni-base alloy tubes.

20. A method of heat treatment according to claim 10, wherein the Ni-base alloy tube is part of a group of tubes undergoing the same heat treatment and the heat treatment is repeated on a second group of Ni-base alloy tubes.

* * * * *